US005228520A

United States Patent [19]

Gottschalk

[11] Patent Number: 5,228,520

[45] Date of Patent: Jul. 20, 1993

[54] SPRINKLER SYSTEM FOR REFRIGERATED SPACES

[76] Inventor: Holger Gottschalk, Am Kortenhoop 47, D4930 Minden, Fed. Rep. of Germany

[21] Appl. No.: 809,402

[22] Filed: Dec. 18, 1991

Related U.S. Application Data

[63] Continuation-in-part of Ser. No. 585,151, Oct. 9, 1990, abandoned.

[30] Foreign Application Priority Data

Dec. 22, 1988 [DE] Fed. Rep. of Germany ..... 3843740

[51] Int. Cl.[5] ..... A62C 35/58; A62C 35/68; A62C 35/62; A62C 3/00

[52] U.S. Cl. ..... 169/17; 169/16; 169/54

[58] Field of Search ..... 169/54, 16, 17

[56] References Cited

U.S. PATENT DOCUMENTS

| | | | |
|---|---|---|---|
| 1,903,150 | 3/1933 | Tyden | 169/17 |
| 3,584,689 | 6/1971 | Willms | 169/17 |
| 3,759,331 | 9/1973 | Livingston | 169/17 |
| 3,834,462 | 9/1974 | Orloff et al. | 169/17 |
| 4,177,862 | 12/1979 | Bray | 169/17 |
| 4,220,208 | 9/1980 | Jackson | 169/17 |

FOREIGN PATENT DOCUMENTS

| | | | |
|---|---|---|---|
| 2703004 | 7/1978 | Fed. Rep. of Germany | 169/17 |
| 2816369 | 10/1978 | Fed. Rep. of Germany | 169/17 |
| 3843740 | 2/1990 | Fed. Rep. of Germany | 169/17 |
| 3938394 | 5/1991 | Fed. Rep. of Germany | 169/54 |

*Primary Examiner*—David M. Mitchell
*Assistant Examiner*—James M. Kannofsky
*Attorney, Agent, or Firm*—Salter, Michaelson & Benson

[57] ABSTRACT

The invention concerns a sprinkler system for refrigerated spaces and sets the task of assuring a longer minimum-time functional capacity for such devices after they have been switched to the operating state. This objective is resolved by an overdimensioning of the piping in combination with special dry sprinklers.

1 Claim, 1 Drawing Sheet

SPRINKLER SYSTEM FOR REFRIGERATED SPACES

BACKGROUND AND SUMMARY OF THE INVENTION

This is a continuation-in-part of application Ser. No. 07/585,151 filed Oct. 9, 1990, now abandoned.

The invention concerns a sprinkler system for refrigerated spaces as a shelf protection unit or the like, consisting of several sprinklers, which are supplied with a predetermined volumetric flow of quenching water in the operating state by means of pipings arranged in the refrigerated space.

In sprinkler systems in refrigerated spaces there is the problem that the systems may become quickly nonfunctional in both the resting (standby) state, as well as in the operating state, due to icing up, i.e., if the pipings are arranged within the refrigerated space and subjected to the direct cold effect, which, e.g., cannot be avoided with shelf-protection sprinkler systems.

In the resting state, the systems are free of quenching water and filled with a sensor medium, e.g., compressed air at 3 bars, which escapes in the operating state when the sprinkler is opened and the quenching water is allowed to flow. The sensor medium present in the system in the resting state must, however, be extensively dehumidified or must be as completely dry as possible so that in the resting state, ice cannot build up in the pipings nor on the opening mechanism of the sprinkler, and in this way cause the system to become nonfunctional in the resting state. In order to achieve this effect, it is proposed that the sensor medium in the system be subjected to a single o repeated drying test, which can be conducted relatively simply with commercial drying equipment, particularly with the use of the heat of evaporation present in refrigerated spaces.

The problem which is the basis of the invention, however, does not occur in the resting state, but in the operating state of the sprinkler system, i.e., after opening at least one sprinkler, or if the system is switched into the operating state for any other reason, and the quenching water flows into the system.

The quenching water flowing into the device and through the pipings as well as the opened sprinklers freezes very quickly, so that the pipings and the sprinklers become covered with ice. Within a short time this leads to the inability of the sprinkler system to function and does not assure compliance with fire-protection regulations, for which it is necessary that sprinkler systems, even in refrigerated spaces, must remain functional for at least one to two hours after switching to the operating state.

It has already been proposed to assure the minimum-time functional capacity of sprinkler systems in the operating state in refrigerated spaces by using commercial heat insulation of the pipings and the sprinklers, but the risk is also increased that the insulating material and the type of insulation will favor the spreading of a fire.

The task of the invention is thus to create a sprinkler system of the type defined initially for refrigerated spaces, which assures the minimum-time functional capacity of the system in the operating state, without, however, the use of commercial insulating materials.

This task is resolved by the invention in that the cross-sectional area of the pipings is greater than (preferably at least double) that which is necessary for the calculated predetermined volumetric flow of quenching water, and that the sprinklers are formed as so-called dry sprinklers, in which the flow-through non-return valve lies essentially in the axial center of the piping, and the guide lines branched from the pipings to the sprinklers are held free from the sensor medium of the sprinkler system in the resting state of the system.

According to the instructions of the invention the piping cross section of the sprinkler device is to be constructed specifically much larger than (at least double) that which would correspond to the computed predetermined pipe cross section of the system. For example, a pipe diameter calculated as 1–2 inches according to the conventional calculation method should be dimensioned by some multiple larger according to the instructions of the invention, and in the constructed system was approximately 6 inches.

Due to the overdimensioning of the pipings of the sprinkler system, it remains assured that the piping cross section cannot be obstructed by ice formation on the inner walls in the operating state prior to the end of the desired minimum time. In this way, the formation of the ice layer on the inside walls of the pipe is specifically allowed for and is even desired for thermal reasons, since the buildup of the ice layer on the inside walls of the pipe also has an insulating function, which prevents the further buildup of ice and thus the complete obstruction of the piping cross section.

Physically, for a specific refrigerated space, the time required for the buildup of ice up to a specific free-flow cross section remaining in the axial center of the piping when the system is operational with the use of an overdimensioned pipe cross section according to the invention can be calculated without anything further; this flow section can still allow the passage of the volumetric flow of quenching water, for which the sprinkling system is designed. In this way, any desired minimum-time functional capacity of the piping of a sprinkler system according to the invention can be assured with high reliability.

In order to achieve the same assurance with respect to the sprinklers through which the quenching water passes, the instructions of the invention provide that the overdimensioned pipings of the system will operate in combination with dry sprinklers, the essential features of which are indicated in the claims.

The proposed sprinklers have the advantage that the inlets of their flow-through non-return valves are positioned approximately in the axial center of the piping, so that they lie in the region of the central flow cross section of the piping, thus in the region remaining free of ice buildup for the longest time. Accordingly, the functional capacity in the operating state of the system can also be given for all sprinklers for a minimum time, and this can be calculated in advance.

The instructions of the invention are independent of whether flowing or stationary water is present in the system pipings after switching to the operating state. Also, they are independent of the configuration of the piping network, which may be connected, if necessary, even in the cycle with the quenching-water return lines, which may be arranged inside or outside the refrigerated space.

DESCRIPTION OF THE DRAWINGS

In the drawings which illustrate the best mode presently contemplated for carrying out the present invention.

DESCRIPTION OF THE INVENTION

Figure 1:
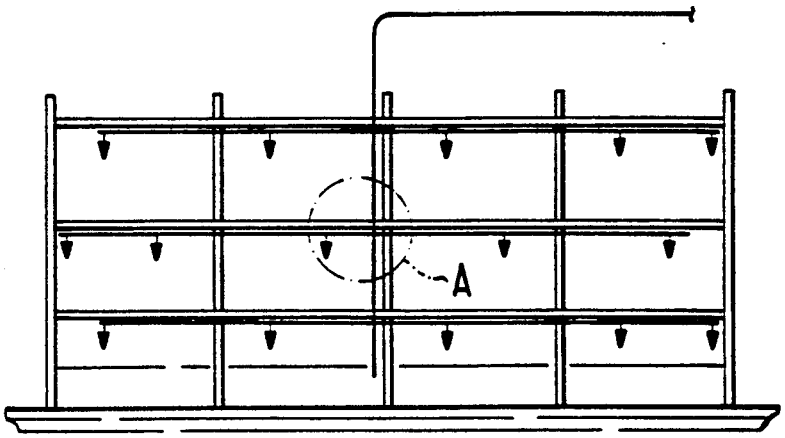
FIG. 1 is a schematic view of a store shelf having the sprinkler system of the instant invention thereon.
Figure 2:
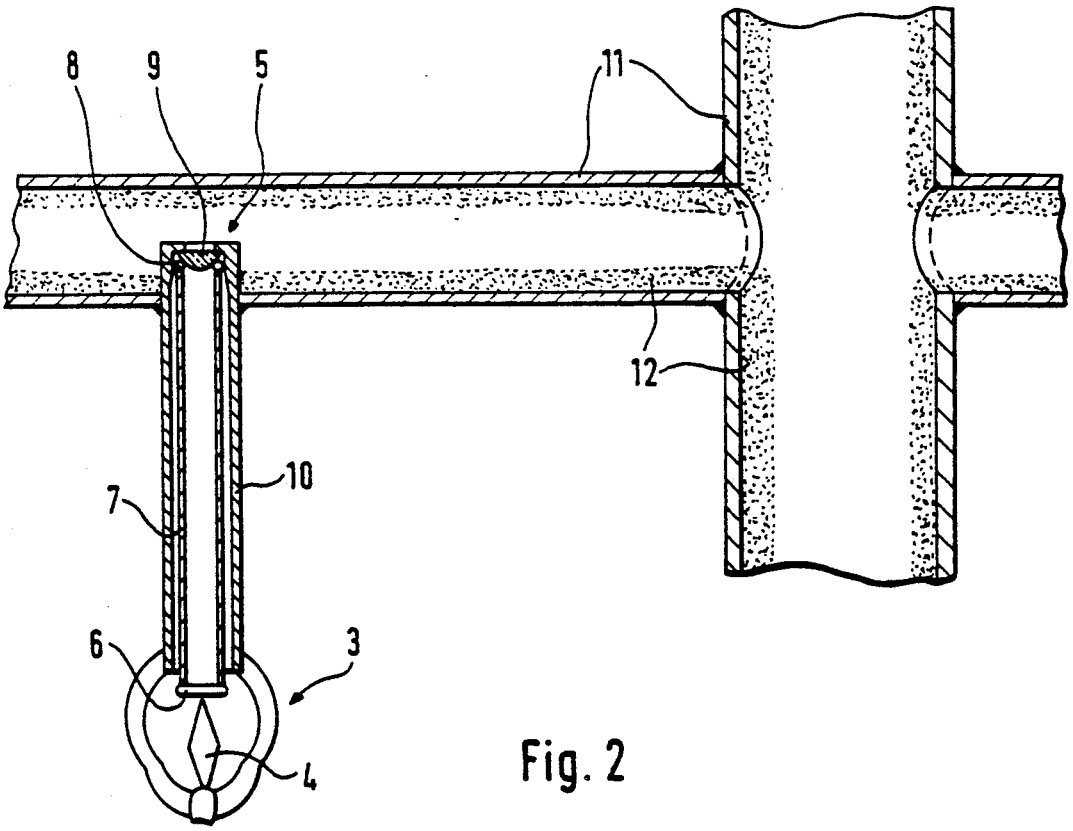
FIG. 2 is an enlarged sectional view of detail A of FIG. 1.

Referring to the drawings, the system of the subject invention includes a plurality of conventional sprinkler heads 3, each having a heat detector support element 4 which can alternatively be made of a fusible alloy, or which can comprise a glass bulb containing a thermally expandable liquid which ruptures the glass bulb upon exposure to heat. Each of the support elements 4 is operative for maintaining a conventional valve 5 in a closed position. Each of the valves 5 is designed in accordance with conventional fire protection design practices to dispense water to the surrounding area at a predetermined flow rate, and each includes a cross member 6 on a tube 7, a plurality of balls 8, a sealing element 9 and a sprinkler pipe 10. Each of the valves 5 is mounted in substantially perpendicular relation to a distribution pipe 11 of a piping network 13, so that the upper end of each valve 5 is positioned along the longitudinal center line or axis of the distribution pipe 11. Each of the valves 5 is assembled so that the cross member 6 thereof is supported by the support element 4 thereof for maintaining the tube 7 thereof in the sprinkler pipe 10 thereof. The balls 8 of each valve are positioned around the upper end of the tube 7 thereof and each of the sealing elements 9 is operative for sealing the upper end of the valve 5 thereof. The piping network 13 further includes a plurality of feeder pipes 14 which are operative for delivering water to the distribution pipes 11 when one of the valves 5 is opened. The pipes 11 and 14 in the piping network 13 are designed so that the cross sectional areas thereof are at least double what would normally be required by conventional fire protection design techniques and standards to supply water to the valves 5 at the respective predetermined flow rates thereof.

Under normal conditions the distribution pipe 11 is maintained filled with a sensor medium, such as compressed air. However, because the valves 5 are maintained in closed positions by the sensor elements 4 thereof, the sensor medium does not enter the valves 5 under normal conditions.

When one of the support elements 4 is destroyed in response to an elevated temperature condition the cross member 6, tube 7, balls 8 and sealing element 9 thereof fall out of the sprinkler pipe 10 so that water is supplied to the sprinkler pipe 10 from the distribution pipe 11 thereof. When one or more of the valves 5 and the distribution pipes 11 thereof are exposed to freezing conditions ice 12 begins to form on the inner surfaces of the distribution pipes 11 and the feeder pipes 14. However, the ice 12 cannot interfere with the operativeness of the sprinkler system because the pipes 11 and 14 are substantially oversized relative to, the valves 5 and the upper or inlet ends of the sprinkler pipes 10 are located near the longitudinal center lines of the respective pipes 11 thereof. Accordingly, water can still be supplied to the pipes 10 through the center portions of the distribution pipes 11.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In a fire protection system for use in a refrigerated area under freezing conditions, said fire protection system comprising a piping network including a plurality of distribution pipes, each of said distribution pipes having a longitudinal center axis, a plurality of dry-type sprinkler heads associated with said distribution pipes for dispensing water therefrom, each of said dry-type sprinkler heads being designed for dispensing water at a predetermined flow rate, a plurality of sprinkler pipes connected to said distribution pipes, one of said sprinkler heads being mounted on each of said sprinkler pipes, each of said sprinkler pipes having a cross sectional area which is normally sufficient for dispensing water at the predetermined flow rate of the respective sprinkler head thereof, each of said sprinkler pipes having an inlet end, a plurality of valve means, one of said valve means being operative for normally preventing water from entering the inlet end of each of said sprinkler pipes, each of said valve means being actuatable to an open position by the respective sprinkler head thereof in order to permit water to pass through the respective sprinkler pipe thereof at the respective predetermined flow rate of the sprinkler head thereof, said distribution pipes having cross sectional areas which are normally sufficient to enable said distribution pipes to supply water through said sprinkler pipes to the respective sprinkler heads thereof at the respective predetermined flow rates thereof, the improvement comprising said sprinkler pipes being mounted on the respective distribution pipes thereof so that the inlet ends of the sprinkler pipes are disposed along the longitudinal axes of the respective distribution pipes thereof, said distribution pipes being dimensioned such that the respective cross sectional areas thereof are at least double the cross sectional areas which are normally sufficient to enable said distribution pipes to supply water to the respective sprinkler heads thereof at the respective predetermined flow rates thereof.

* * * * *